United States Patent [19]

Brigden et al.

[11] Patent Number: 4,648,138

[45] Date of Patent: Mar. 10, 1987

[54] RETENTION AND QUICK RELEASE MECHANISM

[76] Inventors: Kenneth A. Brigden, London; Michael Briggs, St. Albans, both of England

[21] Appl. No.: 763,403

[22] Filed: Aug. 7, 1985

[30] Foreign Application Priority Data

Aug. 10, 1984 [GB] United Kingdom ..... 8420404

[51] Int. Cl.[4] ..... A44B 11/26; A42C 5/04

[52] U.S. Cl. ..... 2/421; 2/6; 24/645; 24/648

[58] Field of Search ..... 2/421, 6; 24/645, 298, 24/648; 70/459

[56] References Cited

U.S. PATENT DOCUMENTS

| | | | |
|---|---|---|---|
| 2,248,005 | 7/1941 | Lyman | 24/645 |
| 2,694,244 | 11/1954 | Nolan | 70/459 X |
| 3,713,192 | 1/1973 | Wallin | 24/645 |
| 3,789,467 | 2/1974 | Aratani et al. | 24/648 |
| 4,110,847 | 9/1978 | Dera | 2/421 |
| 4,461,044 | 7/1984 | Reiterman et al. | 2/421 |
| 4,559,679 | 12/1985 | Downey | 2/421 X |

FOREIGN PATENT DOCUMENTS

| | | | |
|---|---|---|---|
| 0077015 | 4/1983 | European Pat. Off. . | |
| 2812069 | 4/1979 | Fed. Rep. of Germany | 2/421 |
| 0483783 | 4/1938 | United Kingdom | 24/645 |
| 0894747 | 4/1962 | United Kingdom . | |
| 13885041 | 3/1975 | United Kingdom . | |
| 1430654 | 3/1976 | United Kingdom . | |
| 2029498 | 3/1980 | United Kingdom . | |
| 1592259 | 7/1981 | United Kingdom . | |

*Primary Examiner*—Louis K. Rimrodt

*Attorney, Agent, or Firm*—Birch, Stewart, Kolasch & Birch

[57] ABSTRACT

A retention and quick release mechanism, in particular for securing an oxygen mask (2) to a helmet (4), comprises two flexible cables (12) each attached at one end to the mask (2) and having an attachment head (18) at its other end, and two locking devices (10) each attached to the helmet (4). Each locking device (10) has catch means which automatically engages the attachment head (18) when it is pushed into the housing (30) and manually operable release means.

7 Claims, 10 Drawing Figures

RETENTION AND QUICK RELEASE MECHANISM

Figure 1:
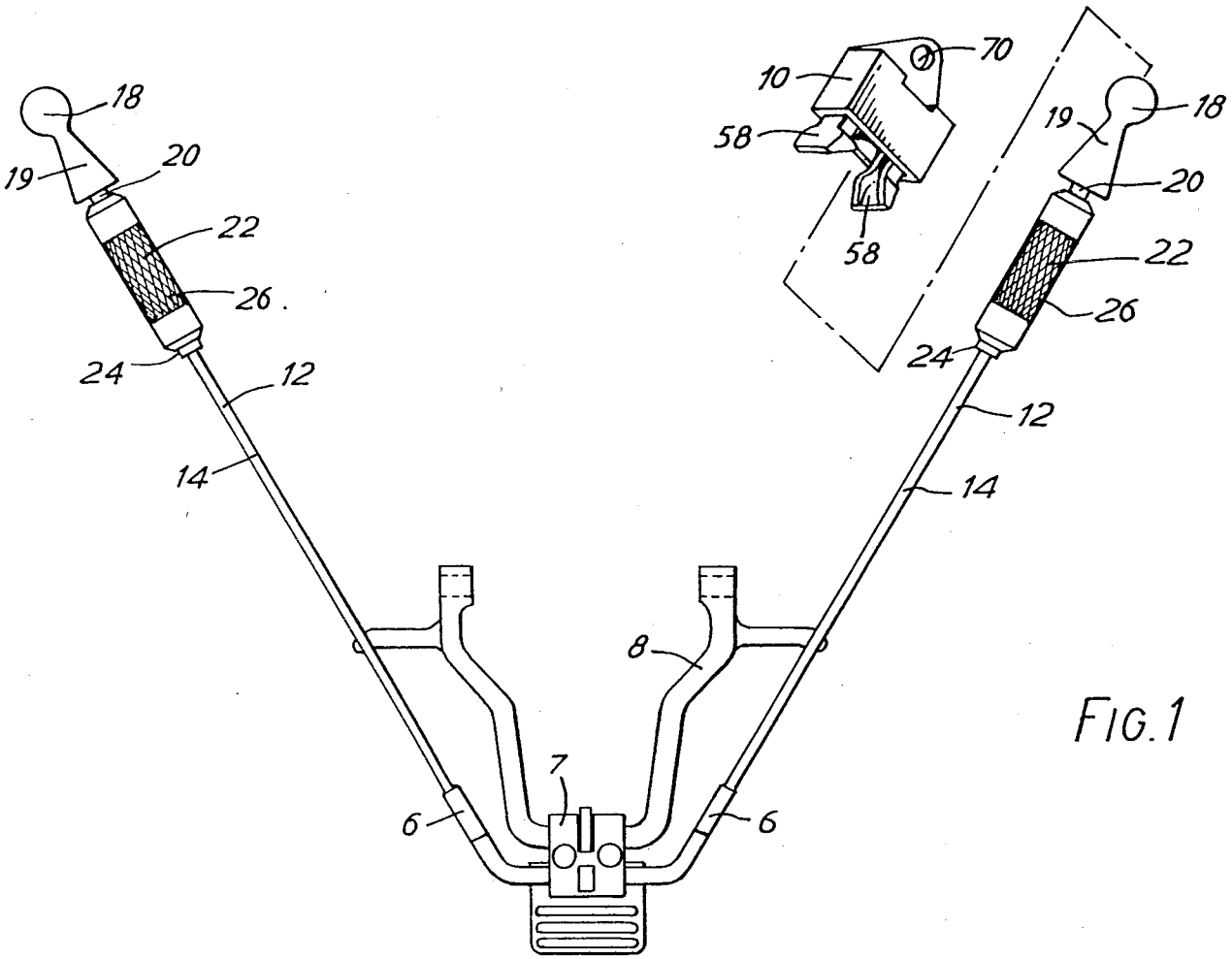

This invention relates to retention and quick release mechanisms.

The invention is concerned in particular with a mechanism for securing a mask or facial protective device to headgear such as a helmet, for example for connecting an oxygen mask to an aircrew helmet.

There are known devices for connecting oxygen masks to aircrew helmets, which consist of two chains each attached at one end to the mask and having at the other end an eyelet adapted to engage over a hook fixed to the helmet. Such a device has the disadvantage that it does not provide a high degree of security of attachment of the mask to the helmet, yet it can be awkward to release quickly in an emergency. In addition, the known device is bulky, and the projecting hooks can be a safety hazard, with a risk of damage to the wearer's face on donning and doffing the helmet.

According to one aspect of this invention, there is provided a retention and quick release mechanism for securing a mask or facial protective device to headgear, comprising at least two flexible members each attached at one end to the mask or facial protection device and having an attachment member at its other end, and a locking device adapted to be attached to, or formed integrally with, the headgear, the locking device having catch means adapted to engage the attachment member when it is moved into engagement with the locking device, and release means on the locking device which are manually operable to release the attachment member.

In one form of the invention the locking device comprises a housing containing at least one retention member movable between a retaining position in which it engages the attachment member and holds it against withdrawal from the housing and a release position in which the attachment member is free to move, and a locking member resiliently biased to a locking position in which it engages the retention member to hold it in the retaining position and being manually movable to a release position in which the retention member can move to its release position.

Preferably, the retention member is resiliently biased to the release position, and is adapted to be engaged by the attachment member and thereby moved to the retention position on movement of the attachment member into the housing.

Preferably, two retention members are provided, each movable between a retaining position and a release position, the two retention members being shaped to partially surround the attachment member in the retaining position thereby to hold the attachment member against withdrawal from the housing, and each being provided with a respective locking member, the arrangement being such that both locking members must be simultaneously in the release position to allow the retention members to release the attachment member.

Suitably, the retention members are pivoted in the housing for rotation about parallel spaced axes, the retention members rotating in opposite directions from one another as they move between the retaining and release positions.

Each locking member may be a lever pivoted in the housing and formed with an element which, in the locking position, engages a corresponding element on the associated retention member to hold the retention member in the retaining position. Suitably, the two levers have grip portions projecting from the housing and positioned so that they can be gripped between the user's finger and thumb and pressed towards one another thereby to rotate each lever to the release position.

In one embodiment of the invention, the attachment member is circular in cross-section, and the retention members have part-circular recesses adapted to engage the attachment member in such a manner as to allow limited pivotal movement of the attachment member.

Suitably, each flexible member is connected to the attachment head through an adjustment device operable to adjust the effective length of the flexible member. Each flexible member is preferably a wire cable.

The mechanism of the invention may be employed to secure an oxygen mask to an aircrew helmet. It may also be used in other circumstances where it is necessary to connect a mask or facial protection device, particularly one incorporating breathing apparatus, to a helmet or other headgear, such as a protective head covering or a harness.

The retention and quick release mechanism of the invention could also be used in other situations where one component needs to be detachably connected to another. The invention therefore includes, in another aspect, a retention and quick release mechanism comprising an attachment member and a locking device as defined above.

Figure 2:
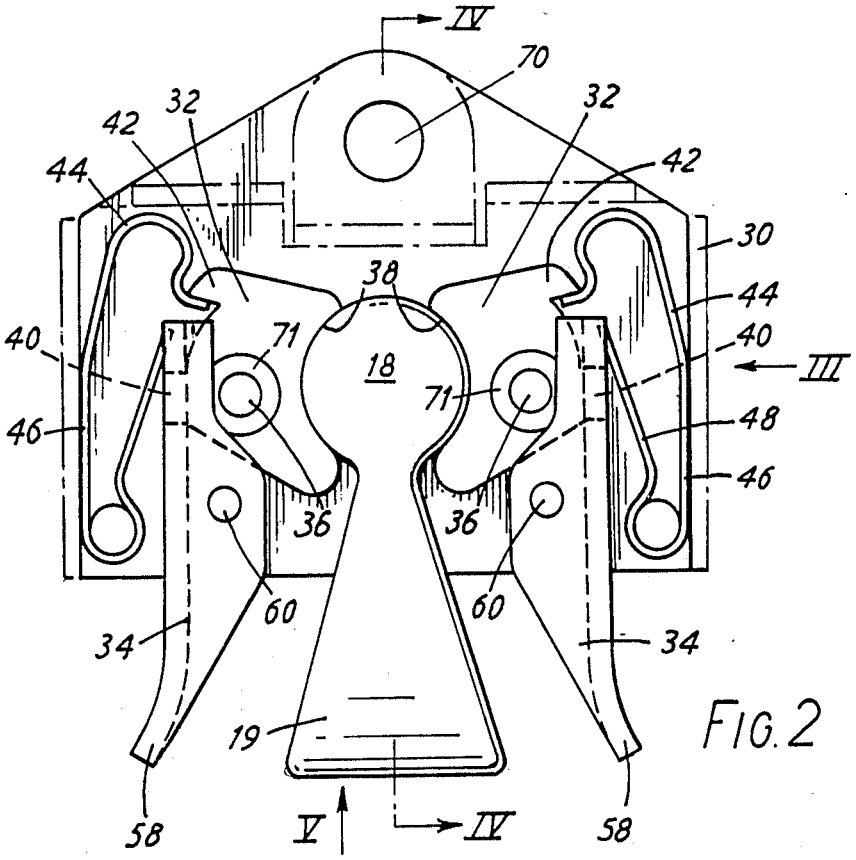
Figure 6:
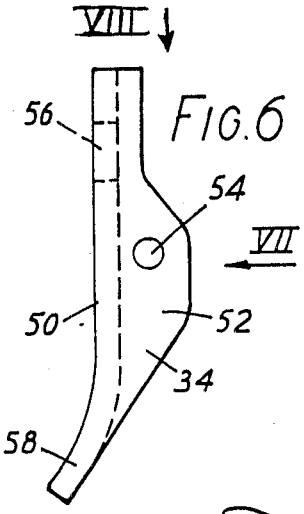
Figure 7:
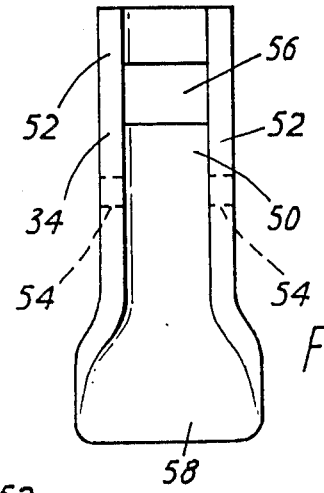
Figure 8:
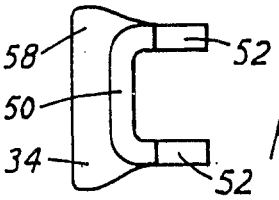
Figure 3:
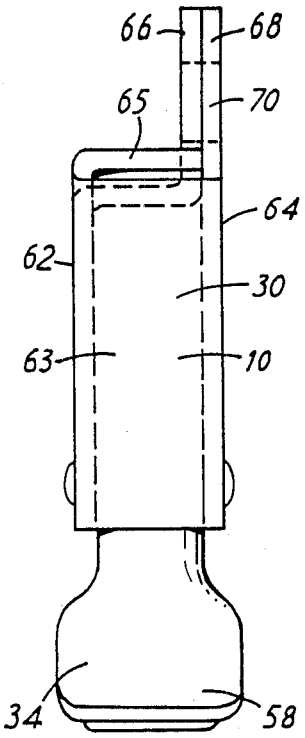
Figure 4:
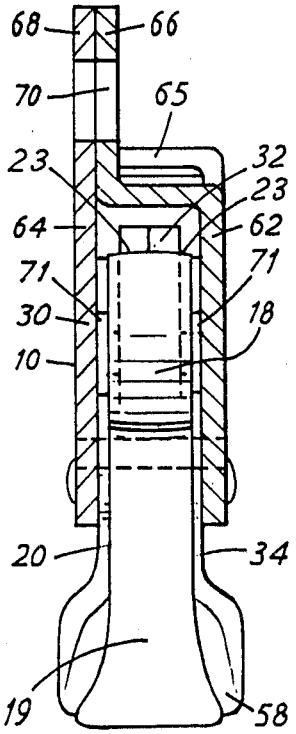
Figure 5:
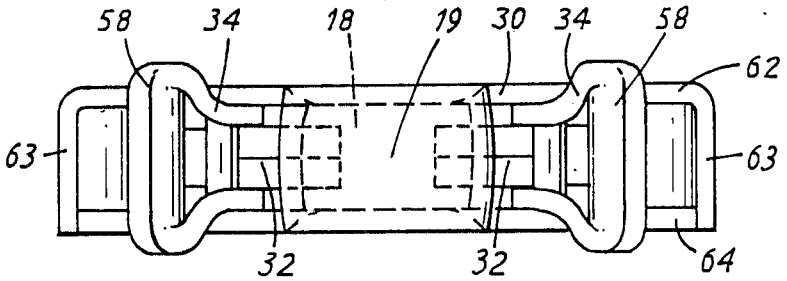
Figure 9:
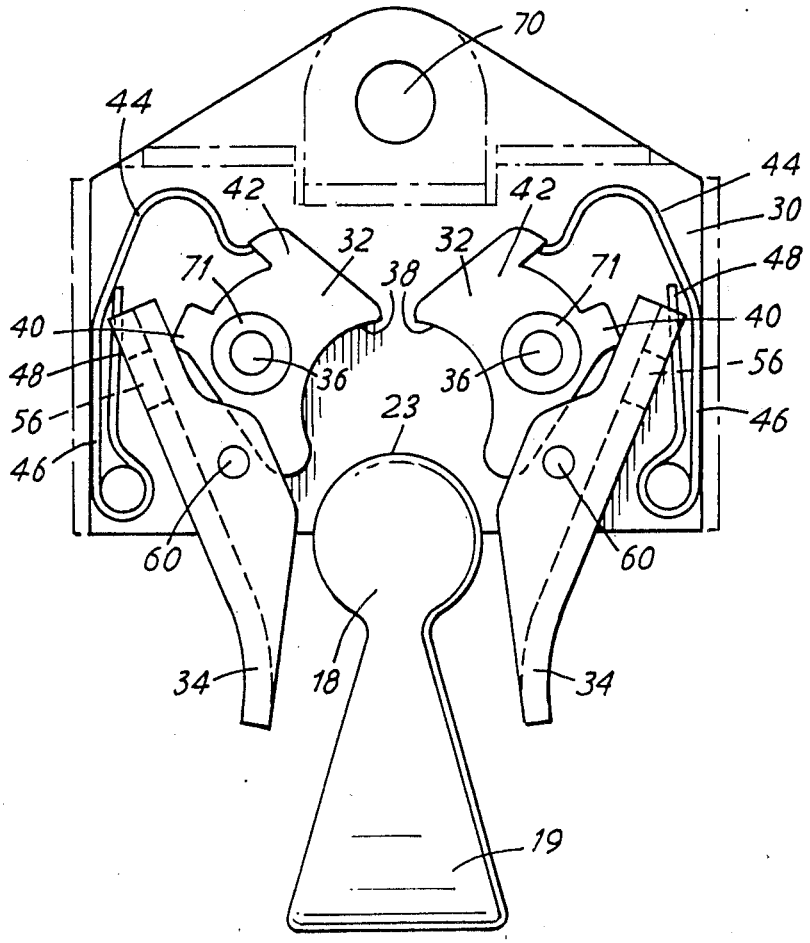
Figure 10:
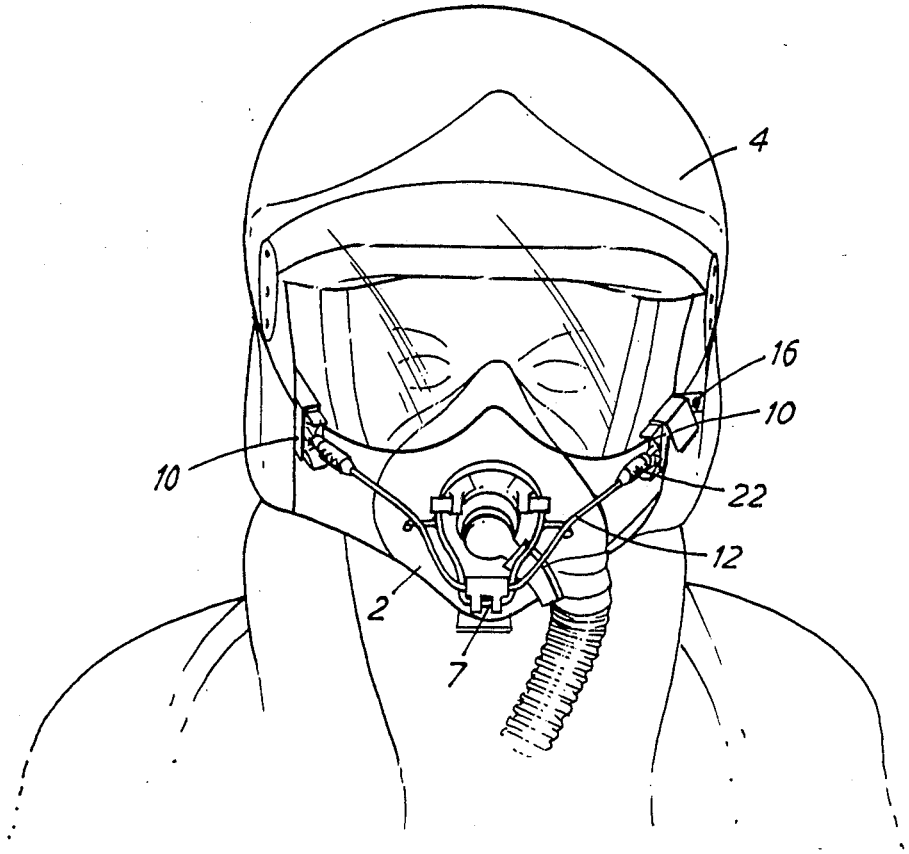

The invention will now be described, by way of example, with reference to the accompanying drawings, in which:

FIG. 1 illustrates a mechanism in accordance with the invention for securing an oxygen mask to an aircrew helmet, FIG. 2 is a view on a larger scale of one of two locking assemblies of the mechanism, with one small of the housing omitted to reveal the interior, and with the assembly in the locking position, FIG. 3 is a view in the direction of arrow III in FIG. 2, FIG. 4 is a cross-section on line IV—IV of FIG. 2, FIG. 5 is a view in the direction of arrow V of FIG. 2, FIG. 6 is a side elevation of a locking member of the assembly, FIG. 7 is a view in the direction of arrow VII of FIG. 6, FIG. 8 is a view in the direction of arrow VIII of FIG. 6, FIG. 9 is a view similar to FIG. 2 but showing the locking assembly in the release position, and FIG. 10 illustrates the mechanism in use.

Referring to the drawings, a retention and quick release mechanism is provided for securing an oxygen mask 2 to an aircrew helmet 4. The mechanism consists of two locking assemblies 10 adapted to be fixed to the helmet 2 and a pair of flexible members 12 adapted to be connected to the oxygen mask 4.

Each flexible member 12 comprises a wire cable 14 adapted to be connected at one end to the oxygen mask. FIG. 1 shows the cable 14 fixed to a rigid cranked member 6 pivoted in a toggle clamp lever 7 which is connected to the mask through a yoke 8. The elements 6, 7 and 8 are similar to those used in the known system employing chains connected to the mask, and so will not be described in detail. The member 6 may be tubular, the end of the cable 14 being secured in the tube, for example by crimping.

At the other end, the cable 14 is secured through an adjustment device 22 to an attachment member in the form of a disc 18 formed in one with a grip portion 19. The grip portion 19 is fixed to a stud 20 which is held captive in the body 26 of the adjustment device whilst being able to turn about its axis relative to the body 26. The cable 14 is fixed to a threaded member 24 which engages an internally threaded bore in the body 26. Rotation of the body 26 enables the effective length of cable between the mask 2 and the disc 18 to be varied, so that the tension with which the mask is held to the user's face can be adjusted. Suitable stop means are provided to prevent the member 24 from being withdrawn completely from the body 26.

The locking assembly 10 comprises a housing 30 containing a pair of retaining cams 32 and a pair of locking levers 34.

The retaining cams 32, each of which is a mirror image of the other, are mounted on pins 36 for pivotal movement about parallel axes. Each cam 32 is fixed to its pin 36, which extends between bearing recesses in a front wall 62 and rear wall 64 of the housing 30. The cam may be formed in two halves, of the same shape, as shown in FIG. 4, each half being fixed to the pin 36 so that the two halves move as one. Washers 71 are interposed between each cam 32 and the walls 62 and 64 of the housing to centrally position each cam. The cams 32 are movable between a closed position, shown in FIG. 2, and an open position, shown in FIG. 9. Each cam 32 is formed with a part-circular recess 38, the recesses 38 of the two cams facing one another in the closed position of the cams and arranged to fit closely against the disc 18 when it is positioned between the cams. The complementary shapes of the disc 18 and recesses 38 allow the disc to turn through a limited angle about its centre when the cams 32 are in the closed position. In addition, the peripheral face 23 of the disc 18 is slightly barrel-shaped, as shown in FIG. 4, and this allows some lateral pivotal movement of the disc 18. This limited freedom of movement of the disc 18 enables the cable 12 to take up an optimum position in use. The pivot axes 36 are positioned so that when the cams are in the open position the disc 18 can move freely outwards from between the cams 32.

Each cam 32 is formed, on the side of the pivot 36 opposite the recess 38, with a projection 40 which is arranged to engage the associated locking lever 34, as described below, to hold the cam 32 in the closed position. The cam is also formed with a second projection 42, which is engaged by the free end of one arm 44 a leaf spring 46 mounted in the housing 30, to bias the cam 32 to its open position.

Each locking lever 34 consists of a base 50 and two side pieces 52 projecting from the base and having holes 54 to receive a pin 60 on which the lever is pivoted. The pin 60 extends between and is fixed to the front and rear walls 62 and 64 of housing 30. The base 50 of each lever 34 is formed near one end with a rectangular aperture 56 shaped to receive the projection 40 of the associated cam 32. At its other end, the base 50 curves outwards and widens to form a grip portion 58 which can be engaged by the user's finger or thumb as described below.

The pivot pin 60 of each lever 34 is spaced from the pivot 36 of the associated cam 32 so that, with the cams 32 in the closed position as shown in FIG. 2, the projection 40 on the cam engage in the aperture 56 in the lever 34, to hold the cam 32 in the closed position. Each lever 34 is biased to the locking position shown in FIG. 2 by the other arm 48 of the associated leaf spring 46, and can be pivoted to a release position, shown in FIG. 9, in which the projection 40 on the cam 32 is disengaged from the aperture 56 in the lever 34. When both the levers 34 are in the release position the cams 32 are free to move, under the influence of the leaf springs 46, to the open position. The levers 34 are positioned so that the two grip portions 58, which project outwards from the housing 30, can be engaged by a finger and thumb of the user and squeezed together to move the levers to the release position.

The housing 30 is constructed from two pieces, one forming the front wall 62 and side walls 63 and the other forming the rear wall 64. At one end the housing is open, the grip portions 58 of the locking levers 34 extending from the open end of the housing. At the other end, the front wall 62 is bent to form an end wall 65, the central portion of which extends into a lug 66 which lies flat against a lug portion 68 of the rear wall 64. A bore 70, formed in the lugs 66 and 68, enables the housing to be attached to a helmet by means of a bolt passing through the bore. The bolt may be of a diameter slightly less than that of the bores, so that each housing 30 can in use pivot on the bolts, to enable the cables 12 to take up an optimum position. The housing may be attached to the outside of the helmet, by means of a bolt 16, as illustrated on the right-hand side of FIG. 10. Alternatively, the housing may be fixed to an inner face of the helmet, as shown on the left-hand side of FIG. 10.

The housing 30 and the various components of the locking devices may be made of any suitable material, such as metal of plastics.

In operation, to connect the flexible member 12 to the locking assembly 10, the disc 18 is pushed into the housing 30 so that it engages the cams 32, which are in the open position. Continued movement of the disc 18 rotates the cams 32 to the closed position, until the projection 40 on each cam 32 reaches the aperture 56 in the associated locking lever 34. At that point, the locking levers 34 snap into the locking position, to hold the cams 32 in the closed position. In this position, the disc 18 is held against withdrawal by the cams 32, though it can turn to a limited extent as described above, to allow the cable 12 to move to an optimum position. To release the disc 18, both levers 34 are pivoted, by moving the projecting portions 58, until they reach the release position, shown in FIG. 9. The cams 32 are then moved to the open by the springs 44, to release the disc 18.

The mechanism thus enables the oxygen mask 2 to be quickly secured to the helmet 4, by simply pushing the discs 18 into the housing 30. The mask can be quickly released by operating the locking levers 34, by squeezing the two grip portions 58 towards each other between the finger and thumb. It will be apparent that movement of only one of the locking levers to the release position will not release the disc 18, since the cams 32 will be held by the other locking lever 34. It is therefore necessary positively to move both levers 34 to release the disc 18, and this provides a safeguard against the mask being accidentally released by inadvertent engagement of one of the locking levers.

It will be appreciated that modifications could be made in the described embodiment. For example, the cams and locking levers could be of different shapes. The attachment head 18 could, instead of being disc-shaped, be made in other configurations, for example spherical or in the shape of an arrow head, the recesses in the cams being shaped appropriately. The housings of the locking devices could be formed integrally with the helmet.

We claim:

1. A retention and quick release mechanism for securing a mask or facial protective device to headgear, comprising at least two flexible members each attached at one end to the mask or facial protection device and having an attachment member at its other end, and a locking device for receiving each said attachment member, said locking device comprising:

(a) a housing, (b) means for attaching said housing directly to the headgear, (c) two retention members mounted in said housing for rotation about parallel spaced axes between a retaining position and a release position, (d) said retention members being shaped to partially surround said attachment member in the retaining position so as to hold the attachment member against withdrawal from said housing and to release said attachment member only when both said retention members are in the release position, (e) means resiliently biasing said retention members to the release position, said retention members and said attachment member being shaped so that as said attachment member is pushed into said housing it engages said retention members and rotates them against the bias of said biasing means to the retaining position, (f) two locking members, one for each of said retention members, each mounted in the housing for rotation between a locking position in which it engages the associated said retention member to hold it in the retaining position and a release position in which said retention member can move to its release position, (g) means resiliently biasing each said locking member to the locking position, (h) each said locking member having the grip portion projecting from said housing, said two grip portions being positioned so that they can be gripped between the user's finger and thumb and pressed towards one another thereby to rotate the levers simultaneously to the release position, (i) said retention members, locking members and attachment members being arranged so that said retention members can move to their release position only when both said locking members are in the release position.

2. A mechanism as claimed in claim 1, in which said retention members are pivoted in said housing for rotation about parallel spaced axes, said retention members rotating in opposite directions from one another as they move between the retaining and release positions.

3. A mechanism as claimed in claim 2, in which said attachment member is circular in cross-section, and said retention members have part-circular recesses adapted to engage said attachment member in such a manner as to allow limited pivotal movement of said attachment member.

4. A mechanism as claimed in claim 1, in which each said locking member is a lever pivoted in said housing and formed with an element which, in the locking position, engages a corresponding element on the associated said retention member to hold the retention member in said retaining position.

5. A mechanism as claimed in claim 1, in which each said flexible member is connected to the associated said attachment member through an adjustment device operable to adjust the effective length of said flexible member.

6. A mechanism as claimed in claim 5, in which each flexible member is a wire cable.

7. A mechanism as claimed in claim 1, and adapted to secure an oxygen mask to an aircrew helmet.

* * * * *